United States Patent [19]

Myers, deceased et al.

[11] 3,953,317

[45] Apr. 27, 1976

[54] COMPOSITION AND METHOD FOR SEPARATING BITUMINOUS CONSTITUENTS FROM BITUMINUM-BEARING SANDS

[76] Inventors: Elman B. Myers, deceased, late of Wayne, N.J.; by Marian M. Myers, administratrix, 550 Berdan Ave., Wayne, N.J. 07470

[22] Filed: Feb. 21, 1974

[21] Appl. No.: 444,566

[52] U.S. Cl. ..... 208/11 LE
[51] Int. Cl.[2] ..... C10G 1/04
[58] Field of Search ..... 208/11; 260/473.5

[56] References Cited

UNITED STATES PATENTS

| | | | |
|---|---|---|---|
| 2,650,196 | 8/1953 | Rahn | 260/473.5 |
| 2,653,913 | 9/1953 | Van Dijck et al. | 252/550 |
| 2,823,223 | 2/1958 | Steinberg et al. | 260/473.5 |
| 3,517,052 | 6/1970 | Brandts et al. | 260/473.5 |

OTHER PUBLICATIONS

Kirk–Othmer *Encyclopedia of Chemical Technology 2nd Ed. Vol. 12, pp. 314–318.*

Chemical Abstracts 39: 2365[9].

*Primary Examiner*—Delbert E. Gantz
*Assistant Examiner*—James W. Hellwege
*Attorney, Agent, or Firm*—Bain, Gilfillan & Rhodes

[57] ABSTRACT

Compositions and methods for separating bituminous constituents from bituminum-bearing sands, commonly known as "tar sands" in which the composition comprises the product resulting from the addition of ammonium hydroxide with an aqueous solution of tannic acid the method comprising the efficient intermixing, preferably by agitation, of the said tar sands with said composition until the desired separation of the sand from the bituminous fraction is achieved, the rate of separation being increased by increasing the temperature of the composition, and separating the bituminous fraction from said composition.

10 Claims, No Drawings

COMPOSITION AND METHOD FOR SEPARATING BITUMINOUS CONSTITUENTS FROM BITUMINUM-BEARING SANDS

BACKGROUND OF INVENTION

It has been estimated that there are in excess of 915 billion barrels of bitumen in 19 major deposits of what are commonly known as "tar sands," The Major Tar Sand Deposits of the World, Phizackerley and Scott, Panel Discussion No. 13, Topic No. 1, The World Petroleum Congress, Mexico City, Apr. 1967. By 1973, petroleum production had diminished sufficiently with respect to demand to generate a world energy crisis. Currently the United States is virtually totally dependent upon Near Eastern petroleum to meet increases in petroleum demands. Irrespective of the vagaries of international politics, there is an ever increasing demand for petroleum with an ever decreasing availability which threatens a world-wide depression.

There are major tar sand deposits in the following eight nations: Canada, Venezuela, The United States, Malagasy, Albania, Trinidad, Rumania and The U.S.S.R. By far, the greatest deposits are located in the province of Alberta, Canada in an area of approximately 30,000 square miles commonly referred to as the Athabasca Tar Sands.

Tar sand deposits may lie either exposed or covered with an overburden of varying thicknesses up to approximately 3,000 feet. Of the 700 billion barrels of crude oil estimated to lie in the Athabasca fields, approximately 15% is free of overburden. Additionally, substantial deposits exist in Eastern Venezuela, Kentucky and Utah which are also free of overburden and total in the millions of barrels.

The composition of the bitumen which permeates the sand varies specifically with respect to location but have many common characteristics. Merely by way of illustration, the Athabasca tar sands comprise fractions ranging from a totally saturated colorless oil having a molecular weight of 360 to a brown-black solid asphaltene with a molecular weight of approximately 2,500. Additionally, there are oil fractions ranging from totally saturated hydrocarbons through a series containing gradually increasing proportions of aromatics. Athabasca Oil Sands, K. A. Clark, Research Council of Alberta, 1963. The various compositions of most of the significant deposits of tar sands have been published. Encyclopedia of Chemical Technology, Second Edition, Volume 19, page 698.

Unlike crude oil deposits which lie in pools, the bitumen in tar sands are not subject to common well-drilling techniques, although a Frasch Process approach appears viable. The sand appears as a tacky to relatively solid black mass and in some instances relatively hard. There are virtually no deposits of free liquid petroleum.

A typical arrangement of tar sand particles discloses a water envelope proximal to the sand particle containing extremely fine solid particles. The water envelope is covered by a continuous bitumen film which interengages with the bitumen film of adjacent sand particles, to form a cohesive mass generally as illustrated in The Encyclopedia of Chemical Technology, Second Edition, Volume 19, page 693. Thus, the bitumen constituent of the tar sands first must be separated from the sand particles and thereafter refined to produce the various usual petroleum distillate fractions.

Various techniques have been proposed for the recovery of bitumen from tar sands. These techniques involve one of two basic approaches: either the tar sand is mined and transported to a processing plant where the bitumen is extracted or the bitumen is extracted from the sand in situ. Additionally, a wide variety of extractive techniques has been proposed and are summarized in The Encyclopedia of Chemical Technology, Second Edition, Volume 19, pages 699 et seq.

The published literature clearly demonstrates that over a period of approximately 47 years, extensive research has been undertaken to develop an economically efficient method for the recovery of bitumen from tar sands without notable success. By 1963, Dr. K. A. Clark, who by then had spent 43 years researching this problem, settled upon a hot water process combining the use of steam, sodium hydroxide and centrifugal force. The great Canada Oil Sands Limited, a subsidiary of the Sun Oil Company expended approximately $235,000,000 on the development of the Clark process which has not achieved significant commercial success.

Additionally, the Canadian Department of Mines and Technical Surveys developed a pilot plant separation process employing cold water and kerosene as a solvent. The kerosene is used in ratios of one-to-one by weight to the bitumen in the feed while the total water added to the process is 2 to 3 times the weight of the feed. Soda ash and wetting agents were also added.

The first step in the cold water process is disintegration of the sand feed mass in a pebble mill together with water, kerosene and other reagents. The pebble mill effluent is mixed with additional water, and fed to a rake classifier to separate the bulk of the sand from the liquid phase. The liquid phase is thickened to concentrate the oil.

The hot water process of Clark includes a wide variety of extremely complicated control conditions and is effected by variations in the composition of the tar sand, particularly its clay content. It is estimated that the overall efficiency of recovery of the Clark hot water process is no greater than 6 to 8%.

Another hot water process has been tested on a laboratory scale by the United States Bureau of Mines as applied to tar sands found in the United States. This process is distinctly different from the hot water process of Clark because a solvent is employed. In the U.S. process, a 33° API fuel oil containing 20 to 25% by volume aromatics is added as a solvent in one-to-three weight ratio based upon the feed bitumen content. The product of this process closely resembles the product derived from the Canadian Mines Branch cold water process. Additionally, it has been found that tar sands which include relatively large concentrations of iron and calcium salts, such as tar sands found in deposits at Edna, California, cannot be extracted by the Clark or U.S. hot water process.

The principal object of the present invention is to provide an inexpensive, single phase separation process applicable to virtually all tar sands resulting in an economic balance which renders the crude oil or other petroleum fractions recovered thereby economically competitive with other sources of such petroleum products.

Another object of the present invention is to provide a composition for the separation of bitumen from tar sands which is rapidly effective under moderate agitation at reasonably low temperatures resulting in an easily recoverable bituminum bearing fraction.

SUMMARY OF INVENTION

A method for the separation of bitumen fraction from bitumen-bearing material comprising adding the composition resulting from the mixing of an aqueous solution of tannic acid with ammonium hydroxide to the bitumen-bearing material in quantities and concentrations just sufficient to result in an efficient separation of the bitumen fraction under agitation sufficient to insure efficient contact between the bitumen bearing material and the said composition.

A composition for separation of bituminous constituents from bitumen-bearing material comprising the product resulting from mixing an aqueous solution of tannic acid with ammonium hydroxide.

PREFERRED EMBODIMENT OF INVENTION

The objects and advantages aforesaid as well as other objects and advantages may be achieved by the compositions and methods hereinafter described and claimed.

As used hereinafter, the term "tar sands" includes any sand or other material bearing bitumen of which deposits in Canada, the United States, Malagasy, Albania, Trinidad, Rumania and the U.S.S.R. are characteristic. The properties of tar sands and in particular the bitumen properties are more particularly described in The Encyclopedia of Chemical Technology, Second Edition, Volume 19, pages 693 et seq. as well as in Athabasca Oil Sands, K. A. Clark, 1963 and The Major Tar Sand Deposits of the World, Phizackerley and Scott, ibid.

The present process contemplates the preparation of a composition resulting from the mixture of tannic acid and ammonium hydroxide which for convenience of nomenclature may be called "ammonium tannate." However, ammonium tannate does not appear in the literature and the precise molecular weight and chemical structure of the said composition is unknown. As used herein, tannic acid refers to those compositions identified more particularly in The Merck Index, Eighth Edition, page 1012. Both technical grade and N.F. Grade Tannic Acid are functional equivalents and are commercially available from Mallinckrodt Laboratory Products. A suitable tannic acid may also be obtained from Fisher Scientific Company, Chemical Manufacturing Division, Fairlawn, N.J.

In producing the said composition employed to separate the bitumen from the tar sands, an aqueous solution of tannic acid is first prepared. Thereafter, the aqueous solution of tannic acid is mixed with concentrated ammonium hydroxide.

The resultant composition is then mixed with a charge of tar sand and thereafter agitated to assure efficient intermixing of the resultant composition and the individual particles of bitumen-enveloped sand.

The said composition causes a separation of the bitumen fraction from the sand particles which fraction then tends to float on the surface of the mother liquor of ammonium tannate.

It has been found that both temperature and agitation influence the rate of separation although it is not believed that agitation of such violent proportions as to impose major shear stresses is required. Rather, only agitation sufficient to insure efficient contact between the bitumen-enveloped sand particles and the ammonium composition is required. Additionally, while temperatures in excess of 70°F. increase the rate of separation, separation will occur at such temperature and certainly significantly beneath temperatures previously employed in known, hot water processes.

Merely by way of illustration and without intending to be limited thereto, the following examples are illustrative of the basic compositions and methods claimed herein.

EXAMPLE I

Commercial grade tannic acid was added to 50 milliliters of water until a saturated solution of tannic acid was achieved. Thereafter, 50 milliliters of 29% ammonium hydroxide measured as $NH_3$ was added to 50 milliliters of the saturated aqueous solution of tannic acid.

The resultant 100 milliliters of the tannic acid-ammonium hydroxide composition was then added to approximately 50 grams of tar sand derived from deposits in Athabasca Canada and bearing approximately 18% bitumen by weight.

The tar sand was agitated by hand sufficiently vigorously to insure efficient intermixing of the liquid and the bitumen-enveloped sand particles for a period of approximately 15 to 20 minutes resulting in an efficient separation of the bitumen from the sand. Upon standing, the sand settled to the bottom of the mother liquor and appeared white. The mother liquor appeared to have an oily surface with some oily droplets suspended therein.

EXAMPLE II

The procedure in accordance with EXAMPLE I was repeated with the exception that 75 milliliters of ammonium hydroxide were added to 25 milliliters of a saturated aqueous solution of tannic acid.

After agitation of the character described in EXAMPLE I, a more rapid and efficient separation appeared to occur.

EXAMPLE III

The procedure as set forth in EXAMPLE I was repeated with the exception that 25 milliliters of ammonium hydroxide were added to 75 milliliters of a saturated aqueous solution of tannic acid. Agitation of the character employed in EXAMPLE I was performed and while separation occurred, it was not as rapid as in the case of EXAMPLES I and II.

EXAMPLE IV

Two grams of commercial grade tannic acid were added to 75 milliliters of water. 0.322 mols of ammonia as 29% ammonium hydroxide were added to the aqueous solution of tannic acid. The resultant composition was diluted with 200 milliliters of water and heated to approximately 60°C.

Fifty grams of tar sand as set forth in EXAMPLE I were added to the resultant solution and hand stirred for 2 to 3 minutes. This resulted in efficient recovery of 40 to 50% by weight of the oil present in the test sample of tar sand which bore 18% bitumen by weight.

EXAMPLE V

The procedure of EXAMPLE IV was repeated with the exception that the agitation was performed at approximately 85°C with the result that somewhat greater quantities of oil appeared to separate from the tar sand.

EXAMPLE VI 2.0 grams of tannic acid were added to 75 grams of water. No ammonium hydroxide was added. Rather, the tannic acid solution without ammonia was heated to approximately 60°C. and 50 grams of tar sands introduced and agitated by hand for 2 to 3 minutes with very little separation of the bitumen fraction. Thereafter 0.293 ammonia as 29% ammonium hydroxide was added to the tannic acid tar sand mix without any significant increase in the separation of the bitumen fraction.

EXAMPLE VII

Twenty five milliliters of an aqueous solution of tannic acid bearing .042 grams of tannic acid per milliliter were added to 2.2 milliliters of 29% ammonium hydroxide. The resultant composition was added to 50 grams of tar sand of the character of EXAMPLE I having approximately 18% by weight bitumen. The entire mixture was then heated to approximately 90°–95°C. and moderately agitated with a mechanical agitator. Bitumen fraction separation commenced at approximately 65°C. and at 90°–95°C. the sand sample appeared to be substantially completely separated from the bitumen fraction.

EXAMPLE VIII

The procedure in accordance with EXAMPLE VII was repeated with the exception that the tannic acid-ammonium hydroxide composition was diluted to the extent of 1/10 by volume with water. There appeared to be good separation at 90°–95°C. with moderate mechanical agitation.

EXAMPLE IX 4.2 grams of tannic acid were mixed with 100 milliliters of water. 4.4 milliliters of 29% ammonium hydroxide were added. The resultant composition was diluted to the extent that there was but 0.0139 grams of tannic acid per milliliter of the said composition. Fifty grams of tar sand of the character of EXAMPLE I were then added to the diluted composition and the mixture heated to 90°–95°C. Separation commenced at 60°–70°C. with moderate mechanical agitation with substantially complete separation at 90°–95°C.

Separation of the mother liquor and bitumen fraction from the solid sand is a matter of choice depending upon other process parameters. The basic principals of the separation of solids from liquids are well known and need not be detailed further.

Separation of the bitumen fraction from the mother liquor of ammonium tannate may be achieved by any one of a number of well known techniques applicable to the separation of oily liquid hydrocarbons from a water-based diluent. These include decantation, centrifugation, distillation, absorption in mixed solvents and the like.

The ammonium tannate does not appear to suffer significant degradation during the separation process particularly if protected from actinic light. It is contemplated that any industrial process employing ammonium tannate as set forth herein would include techniques for recycling the ammonium tannate and for protecting it from degradation due to light and/or oxidation.

It will be understood by those skilled in the art that numerous modifications and variations of the present invention may be made without departing from the spirit and the scope thereof.

I claim:

1. A method for the separation of the bitumen fraction from bitumen-bearing sands comprising:
a. adding the composition resulting from the mixing of an aqueous solution of tannic acid with an ammonium hydroxide solution to bitumen-bearing sands in quantities and concentrations and under condition of intimate contact just sufficient to result in a desired separation of the bitumen fraction from said sands.

2. A method for the separation of the bitumen fraction from bitumen-bearing sands comprising:
a. the procedure in accordance with claim 1 and
b. separating the bitumen fraction from said sands.

3. A method for the separation of the bitumen-bearing fraction from bitumen-bearing sands comprising:
a. the procedure in accordance with claim 2 and
b. separating the bitumen fraction from said composition and recovering and recycling said composition.

4. A method for the separation of the bitumen fraction from bitumen-bearing sands comprising:
a. the procedure in accordance with claim 1 in which
b. the said aqueous solution is saturated with tannic acid.

5. A method for the separation of the bitumen fraction from bitumen-bearing sands comprising:
a. the procedure in accordance with claim 1 in which
b. the said ammonium hydroxide has a concentration of approximately 29% measured as $NH_3$.

6. A method for the separation of the bitumen fraction from bitumen-bearing sands comprising:
a. the procedure in accordance with claim 4 in which
b. the said ammonium hydroxide has a concentration of approximately 29% measured as $NH_3$.

7. A method for the separation of the bitumen fraction from bitumen-bearing sands comprising:
a. the procedure in accordance with claim 6 in which
b. the ammonium hydroxide and tannic acid are mixed in ratios of approximately 1:3 to 3:1 by volume to produce said composition.

8. A method for the separation of the bitumen-fraction from bitumen-bearing sands comprising:
a. the procedure in accordance with claim 1 in which,
b. the said bitumen-bearing sands are agitated in the presence of said composition just sufficiently to result in the separation of the bitumen fraction from said sands as a substantially immiscible liquid in said composition.

9. A method for the separation of the bitumen fraction from bitumen-bearing sands comprising:
a. the procedure in accordance with claim 8 and
b. separating the bitumen fraction from said composition.

10. A method for the separation of the bitumen fraction from bitumen-bearing sands comprising:
a. the procedure in accordance with claim 9 and
b. recovering and recycling said composition when separated from said bitumen fraction.

* * * * *